US010578288B2

(12) United States Patent
Wang et al.

(10) Patent No.: US 10,578,288 B2
(45) Date of Patent: Mar. 3, 2020

(54) CONNECTING DEVICE OF STREET LAMP POLE

(71) Applicant: XIAMEN JOINT TECHNOLOGY CO., LTD., Xiamen, Fujian Province (CN)

(72) Inventors: Junshan Wang, Xiamen (CN); Long Hu, Xiamen (CN); Xianliang Lan, Xiamen (CN)

(73) Assignee: XIAMEN JOINT TECHNOLOGY CO., LTD., Xiamen (CN)

( * ) Notice: Subject to any disclaimer, the term of this patent is extended or adjusted under 35 U.S.C. 154(b) by 0 days.

(21) Appl. No.: 16/205,347

(22) Filed: Nov. 30, 2018

(65) Prior Publication Data

US 2019/0226665 A1 Jul. 25, 2019

(51) Int. Cl.

| | |
|---|---|
| ***F21V 21/116*** | (2006.01) |
| ***F21S 8/08*** | (2006.01) |
| ***F21V 23/00*** | (2015.01) |
| ***F21V 19/00*** | (2006.01) |
| ***F21W 131/103*** | (2006.01) |

(52) U.S. Cl.

CPC ..... *F21V 21/116* (2013.01); *F21S 8/086* (2013.01); *F21V 19/00* (2013.01); *F21V 23/002* (2013.01); *F21W 2131/103* (2013.01)

(58) Field of Classification Search

CPC ..... F21V 21/116; F21S 8/086

See application file for complete search history.

(56) References Cited

U.S. PATENT DOCUMENTS

| | | | | |
|---|---|---|---|---|
| 3,965,346 | A * | 6/1976 | Thompson, Jr. | F21V 21/116 362/371 |
| 5,504,665 | A * | 4/1996 | Osteen | F21V 21/26 362/269 |
| 6,015,221 | A * | 1/2000 | Bodell | F21V 21/26 362/370 |
| 6,161,948 | A * | 12/2000 | Hagen | F16M 11/10 362/267 |
| 6,966,679 | B2 * | 11/2005 | Matts | F16C 11/103 362/267 |
| 2011/0002132 | A1 * | 1/2011 | Park | F21V 21/15 362/429 |

(Continued)

*Primary Examiner* — Alexander K Garlen

(74) *Attorney, Agent, or Firm* — McClure, Qualey & Rodack, LLP

(57) ABSTRACT

The invention discloses a connecting device of street lamp pole. The connecting device comprises a first connecting piece and a second connecting piece; the first connecting piece and the second connecting piece are arranged in an independent split mode; one end of the first connecting piece is used for connecting a street lamp holder, and the other end is provided with a mortise; one end of the second connecting piece is used for connecting the lamp pole, and the other end is provided with a tenon capable of being inserted into the mortise; and the mortise is provided with a first combining hole, the tenon is provided with a second combining hole, and when the tenon is inserted into the mortise, the first connecting piece and the second connecting piece are fixed by inserting a bolt into the first combining hole and the second combining hole. According to the invention, the street lamp and connecting device are convenient for mounting, disassembly and maintenance.

8 Claims, 8 Drawing Sheets

(56) References Cited

U.S. PATENT DOCUMENTS

| | | | | |
|---|---|---|---|---|
| 2011/0122634 | A1* | 5/2011 | Liu | F21V 21/116<br>362/427 |
| 2012/0008329 | A1* | 1/2012 | Wang | F21V 15/01<br>362/372 |
| 2012/0300480 | A1* | 11/2012 | Kim | F21V 21/116<br>362/419 |
| 2012/0300481 | A1* | 11/2012 | Kim | F21V 21/30<br>362/427 |
| 2014/0085909 | A1* | 3/2014 | Ahn | F16M 11/10<br>362/382 |
| 2015/0049462 | A1* | 2/2015 | Carlen | F21S 8/086<br>362/95 |

* cited by examiner

CONNECTING DEVICE OF STREET LAMP POLE

FIELD OF THE INVENTION

The invention relates to the street lamp field, and in particular, to a connecting device of street lamp pole.

BACKGROUND OF THE INVENTION

With development of urban construction and continuous improvement of road construction, the street lamp takes an increasing proportion in the urban lighting system, and has been widely applied in public lighting. In order to adapt to the outdoor gale environment, the street lamp basically has an integral design solution. The lamp holder, support rod and lamp pole are welded into a whole, so that the street lamp has a simple and more compact structure, and has a greatly improved ability to resist strong wind. The lamp pole indicates the pole with a bottom end embedded in the ground and a top end erecting. The support rod indicates a connecting device between the lamp holder and the lamp pole.

As the urban size grows, the utilization rate of the street lamp is increasing, and thus the contradiction between the public lighting and the short power supply is more evident. Replacing the existing street lamp with a street lamp using new light sources has been a trend of urban lighting. As a lighting source, LED has entered various lighting fields for its low energy consumption characteristic, and no exception for the street lamp. Following the structure of a traditional street lamp, the integral weld connecting mode is also adopted for the LED street lamp, a simple and compact structure is realized, and thus the cost of the LED street lamp is controllable. However, as a new light source, LED cannot directly use the current lighting power. Therefore, the LED must be equipped with some electronic control elements. In this way, in the long-term working process of the LED street lamp, the damage to parts inevitably occurs. It is troublesome for maintaining the LED street lamp with an integral structure, since the LED street lamp can be repaired by cutting apart the connecting part of the LED street lamp. Accordingly, for the LED street lamp, the connecting structure of the traditional street lamp is not applicable any more.

SUMMARY OF THE INVENTION

To this end, in order to solve the above-mentioned technical problem, the invention aims to provide a connecting device of street lamp pole that can be conveniently mounted, disassembled and maintained.

The technical scheme adopted is that:

A connecting device of street lamp pole comprises a first connecting piece and a second connecting piece; the first connecting piece and the second connecting piece are arranged in an independent split mode; one end of the first connecting piece is used for connecting a street lamp holder, and the other end is provided with a mortise; one end of the second connecting piece is used for connecting the lamp pole, and the other end is provided with a tenon capable of being inserted into the mortise; and the mortise is provided with a first combining hole, the tenon is provided with a second combining hole, and when the tenon is inserted into the mortise, the first connecting piece and the second connecting piece are fixed by inserting a bolt into the first combining hole and the second combining hole.

Preferably, the top of the first connecting piece is provided with a gradienter.

Preferably, the connecting device is provided with a wiring port on the bottom; a channel is formed by passing through the connecting device left and right; the connecting port is communicated with the channel; and an electric wires of the street lamp enter from one end of the channel and stretch out from the wiring port.

Preferably, the channel is provided with a wire clamp slot in a position near the wiring port.

Preferably, the wiring channel is provided with a cover for opening or closing the wiring port.

Preferably, the cover is connected to the bottom of the connecting device with a hinge or in a push-pull mode.

Preferably, a circular channel and a square channel are formed by passing through the connecting device left and right; the circular channel and the square channel intersect and form a "Ω"-shaped channel together; the channel is equipped with a plurality of pipe diameter adjusting pieces; the pipe diameter adjusting pieces comprise a square block capable of being inserted into the square channel and an arc block capable of being inserted into the circular channel; the arc block and the square block are fixed in an up and down direction; and the arc block of each pipe diameter adjusting piece has a different radius.

Preferably, the channel is able to splice a pipe with a diameter of 60 mm; and at least two pipe diameter adjusting pieces with arc blocks of different radius are provided, so that a pipe with a diameter of 50 mm and a pipe with a diameter of 40 mm are able to be inserted, respectively.

Preferably, the connecting device is provided with a fixing piece for matching the lamp pole; the shape of one side of the fixing piece matches the lamp pole; the upper part of the fixing piece is provided with a first hole site; the first hole site is provided with a first bolt for being fixedly combined with the lamp pole; the middle part of the fixing piece is provided with a bushing; the lower part of the fixing piece is provided with a plurality of second hole sites arranged up and down or an elongated slot; and the second hole site or the elongated slot is provided with a second bolt for being fixedly combined with the lamp pole.

Preferably, the shape of one side of the fixing piece is planar or arc.

The invention has the beneficial effects that:

The invention provides a connecting device between the street lamp holder and the lamp pole. The connecting device has a split setting, and realizes detachable connection by a mortise and tenon structure (i.e., concave and convex structure) matching a bolt, so that the street lamp and the connecting device can be conveniently mounted, disassembled and maintained.

BRIEF DESCRIPTION OF THE DRAWINGS

To give a clearer explanation of embodiments related in the present invention or technical solutions in present technique, the figures used in description of embodiments or the present technique will be briefly described as below. Obviously, figures in the following description are only embodiments of the present invention. For those skilled technicians in this field, other figures can be obtained according to these figures without any creative work.

DETAILED DESCRIPTION OF THE ILLUSTRATED EMBODIMENTS

Together with the Figures in the embodiments of the invention, the following text will describe clearly and completely the technical solution implemented in the embodiments of the present invention. Obviously, the embodiments described are merely part of embodiments implemented in the invention, instead of all embodiments. Based on the embodiments in the invention, all the other embodiments obtained by those of ordinary skill without any creative efforts shall fall within the protection scope of the invention.

Embodiment 1

Figure 1:
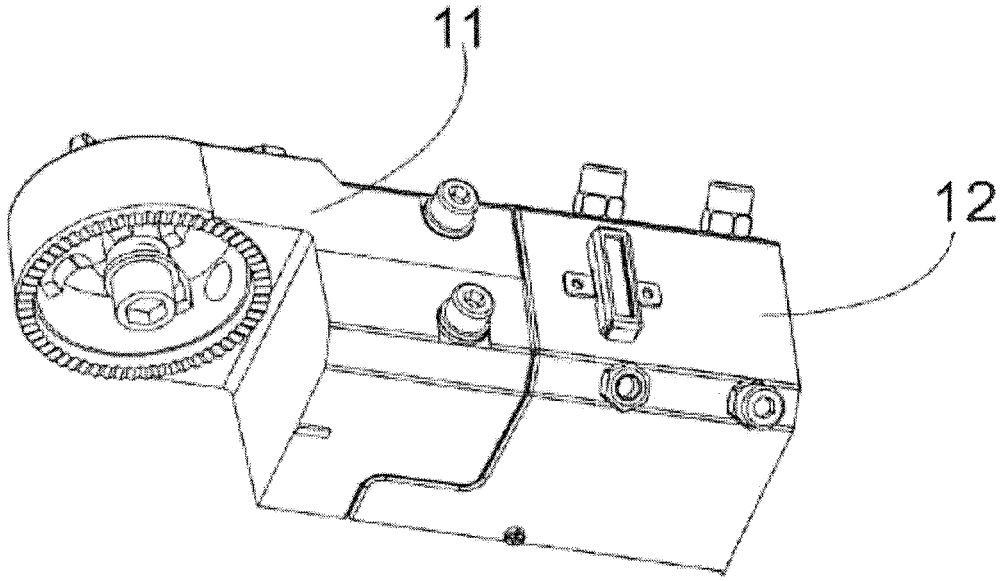
FIG. 1 is a solid structural schematic diagram of a connecting device of street lamp pole of embodiment 1.
Figure 2:
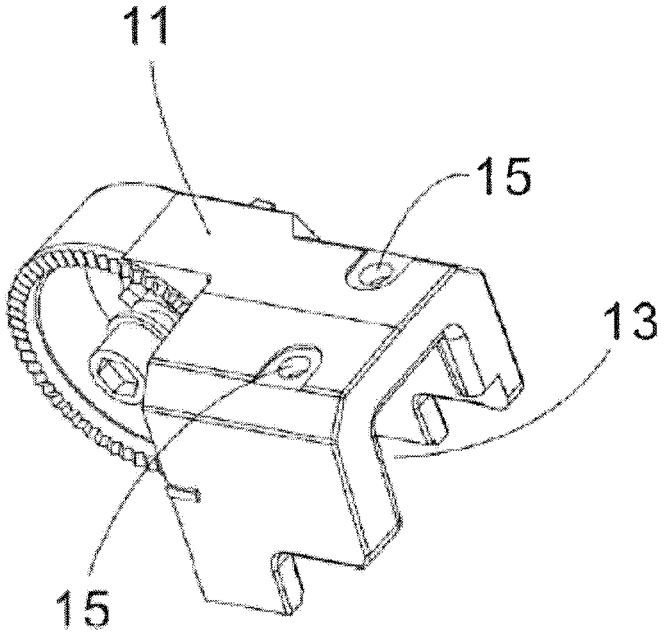
FIG. 2 is a structural schematic diagram of a first connecting piece of the connecting device of street lamp pole.
Figure 3:
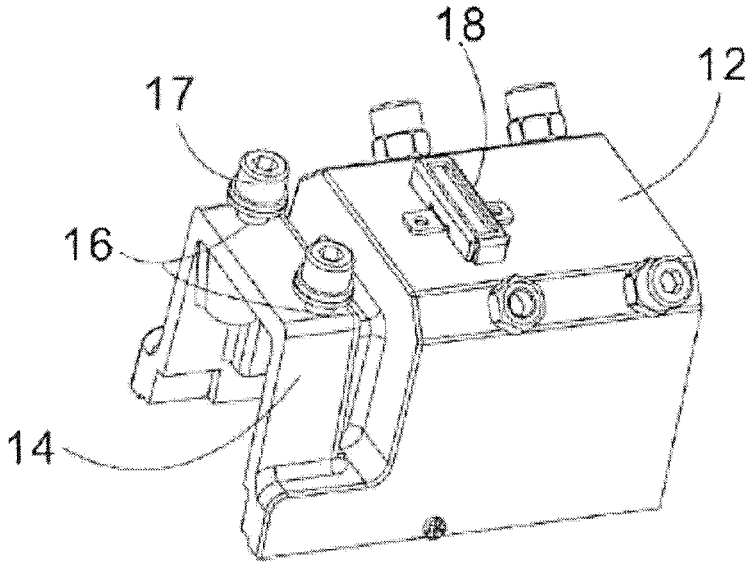
FIG. 3 is a structural schematic diagram of a second connecting piece of the connecting device of street lamp pole.

Referring to FIGS. 1-3, a connecting device of street lamp pole comprises a first connecting piece 11 and a second connecting piece 12; the first connecting piece 11 and the second connecting piece 12 are arranged in an independent split mode; one end of the first connecting piece 11 is used for connecting a street lamp holder, and the other end is provided with a mortise 13; one end of the second connecting piece is used for connecting the lamp pole, and the other end is provided with a tenon 14 capable of being inserted into the mortise; and the mortise 13 is provided with a first combining hole 15 on a mortise wall, the tenon 14 is provided with a second combining hole 16, and when the tenon 14 is inserted into the mortise 13, the first connecting piece 11 and the second connecting piece 12 are fixed by inserting a bolt 17 into the first combining hole 15 and the second combining hole 16.

In the specific implementation, the first and second combining holes are correspondingly provided in two. Certainly, other number may also be set as required, such as, for example, one or three.

As another specific implementation, the top of the first connecting piece is provided with a gradienter 18. The gradienter may be a common cylindrical gradienter that displays horizon in three axial directions (XYZ axes). However, more preferably, as shown in FIGS. 1 and 2, a rectangular gradienter displays whether one axial direction is in a horizontal state. The left and right direction shown in FIG. 1 is the x axis, and the gradienter displays whether the Y axis is horizontal. The rectangular gradienter has a beneficial effect that it shows more accurately and directly whether a direction that is more needed to be known is in the horizontal state. This is because whether the street lamp is mounted obliquely is generally embodied on the Y axis.

The key idea of this embodiment is that the connecting device has a split setting; then, for better connection, the device is configured as a concave and convex structure; and in order to fix more conveniently, a corresponding combining hole and a bolt are provided. Such a structure is convenient for mounting and disassembly. For example, while disassembling, the bolt is loosened, to separate the first connecting piece and the second connecting piece. While mounting, the concave and convex structure is folded and then fixed by inserting a bolt, to realize mounting.

It should be noted that the mortise and the tenon in this specification are opposite. The first connecting piece may also be considered as the mortise from another angle, and the second connecting piece is accordingly the tenon, since the concave and convex structures are opposite. This also belongs to the scope of protection of the invention.

The bolt and the first combining hole/the second combining hole may also be fixed in other manners. However, this belongs to equivalent change and shall also belong to the scope of protection of the invention.

Embodiment 2

Figure 4:
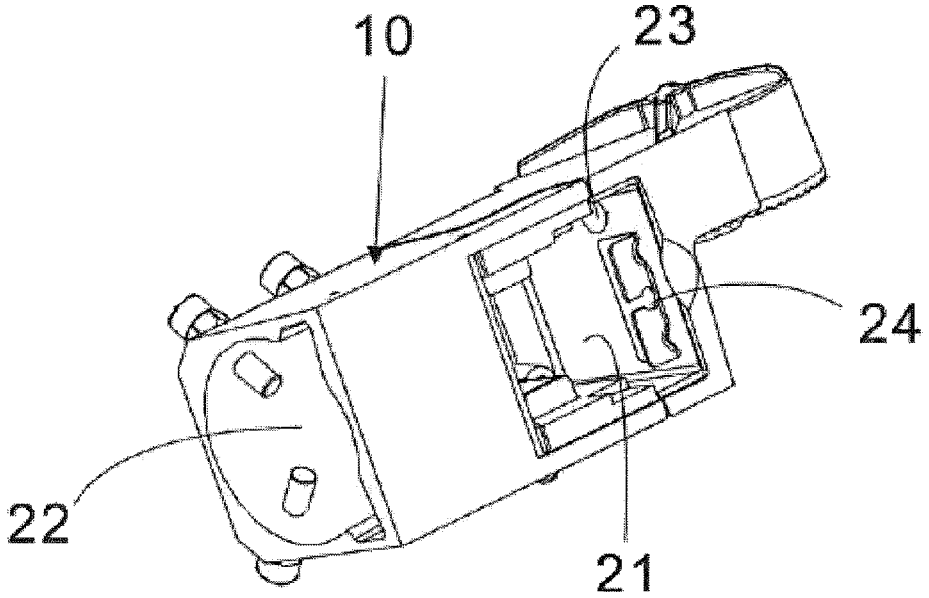
FIG. 4 is a structural schematic diagram of the connecting device (without a cover) of street lamp pole of embodiment 2.
Figure 5:
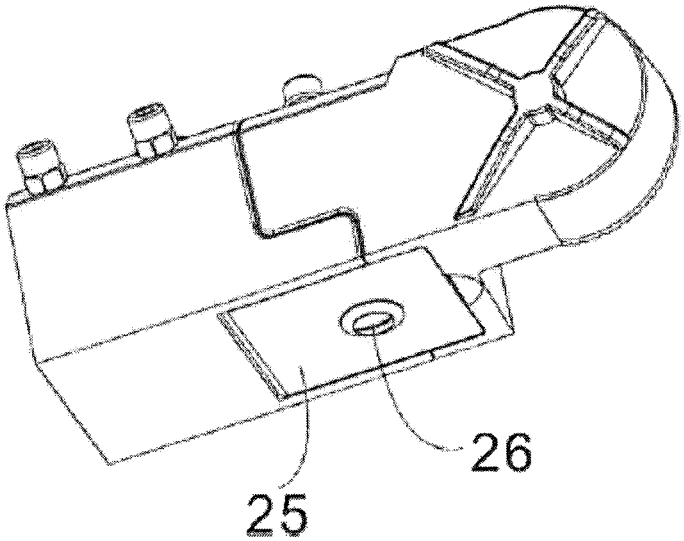
FIG. 5 is a structural schematic diagram of a wiring device (with a cover) of the connecting device of street lamp pole of embodiment 2.

On the basis of the embodiment 1, referring to FIGS. 4-5, the connecting device 10 of the embodiment 1 is provided with a wiring port 21 on the bottom; a channel is formed by passing through the connecting device left and right; in order to facilitate understanding of the channel, FIG. 4 shows a left crossing 22 and a right crossing 23; the channel is located between the left crossing 22 and the right crossing 23; the connecting port 21 is communicated with the channel; and the electric wires of the street lamp enter from one end of the channel and stretch out from the wiring port 21.

As a specific implementation, the channel is provided with a wire clamp slot 24 in a position near the wiring port. The wire clamp slot 24 has a function of enabling a plurality of wirings to be integrated in the wire clamp slot to avoid the wirings from being scattered in the channel disorderly, so that it is more safe, more orderly and cleaner, and wiring is more convenient and efficient since the positions of the wirings are fixed.

As a specific implementation, the wiring channel is provided with a cover 25 for opening or closing the wiring port. As shown in FIG. 5, a screw 26 may be used for corresponding fixing method. Certainly, in addition to this manner, there is further a specific implementation that, the cover is connected to the bottom of the connecting device with a hinge (for short, a hinge type cover), which is convenient to open and close the cover, or the cover is connected to the bottom of the connecting device in a push-pull mode (for short, a push-pull cover). The structure of the push-pull cover may use a common push-pull door structure in the current technique. Such push-pull cover is as convenient as the hinge type cover for opening and closing the cover.

The key of this embodiment is to provide a wiring port, so that corresponding wiring and maintenance of the electric wire can be performed through the wiring port, so as to greatly improve the wiring efficiency and the circuit maintenance efficiency.

Embodiment 3

Figure 6:
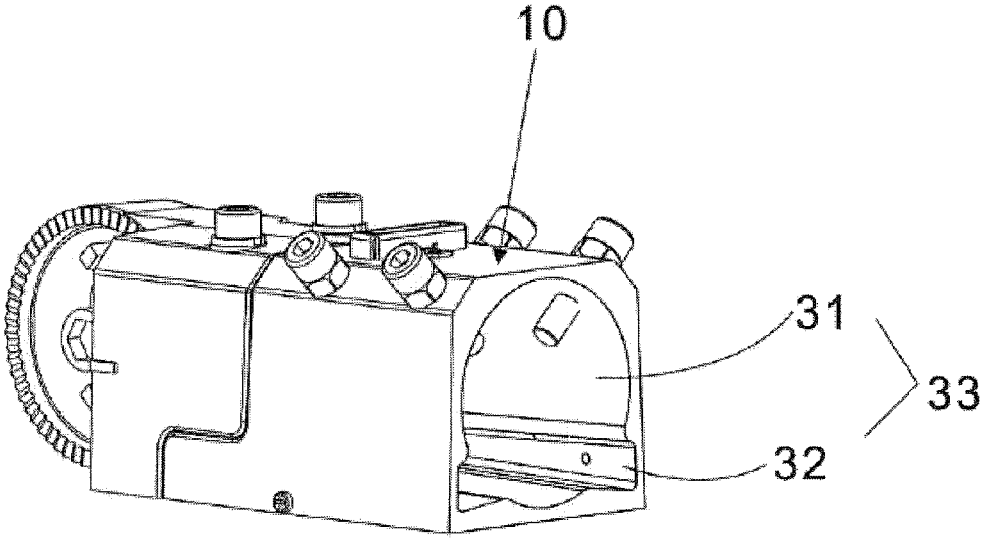
FIG. 6 is a structural schematic diagram of a pipe diameter adjusting device (without a pipe diameter adjusting piece) of the connecting device of street lamp pole of embodiment 3.
Figure 7:
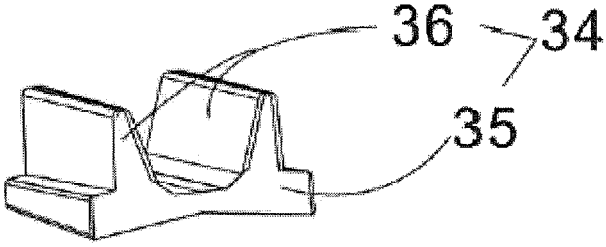
FIG. 7 is a structural schematic diagram of a pipe diameter adjusting piece of embodiment 3.
Figure 8:
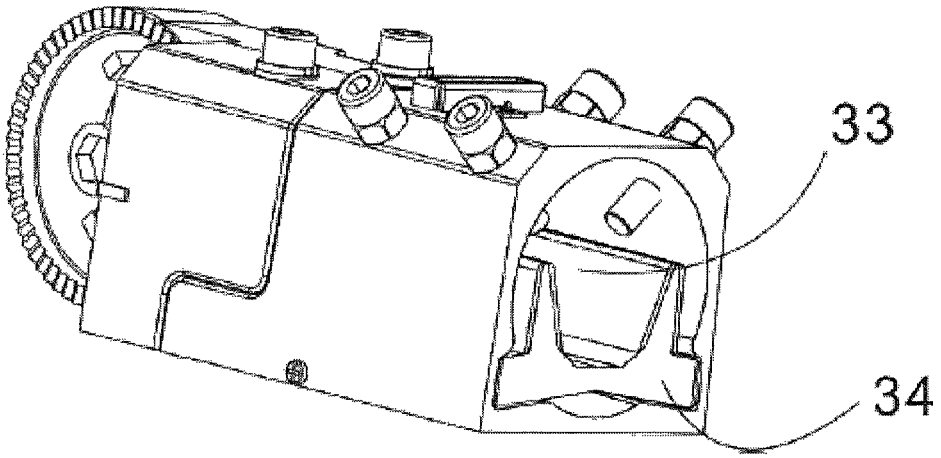
FIG. 8 is a structural schematic diagram of a pipe diameter adjusting device (with a pipe diameter adjusting piece) of the connecting device of street lamp pole of embodiment 3.

On the basis of the embodiment 1, referring to FIGS. 6-8, a circular channel 31 and a square channel 32 are formed by passing through the connecting device 10 of the embodiment 1 left and right; the circular channel 31 and the square channel 32 intersect and form a "Ω"-shaped channel 33 together; the channel 33 is equipped with a plurality of pipe diameter adjusting pieces 34; the pipe diameter adjusting pieces 34 comprise a square block 35 capable of being inserted into the square channel and an arc block 36 capable of being inserted into the circular channel; the arc block 36 and the square block 35 are fixed in an up and down direction; preferably, the arc block 36 and the square block 35 are integrally formed; and the arc block of each pipe diameter adjusting piece has a different radius, that is, some of the arc blocks in the plurality of pipe diameter adjusting pieces have the same radius, and some have different radiuses.

The pipe diameter adjusting piece is optional. As a preferred specific implementation, the channel itself is able to splice a pipe with a diameter of 60 mm; and at least two pipe diameter adjusting pieces with arc blocks of different radius are provided, so that a pipe with a diameter of 50 mm and a pipe with a diameter of 40 mm are able to be inserted, respectively. As such, this pipe diameter adjusting device can adjust three common pipe diameters.

Therefore, according to the size of the pipe diameter of the lamp pole or the size of the lamp pole mounting hole, it can select whether or not to insert a corresponding pipe diameter adjusting piece into the channel, so that the diameter of the channel is adjusted without replacing the lamp pole, and thus the device is adapted to various lamp poles, thereby greatly improving the mounting efficiency.

It should be noted that "square", for example, "square channel" or "square block", described in the specification is not the strictly mathematical square, but a general or an accurate square. A general square, as shown in FIGS. 6 and 7, has two ends slightly leaning downward, so that the stability of the structure can be increased.

Embodiment 4

Figure 9:
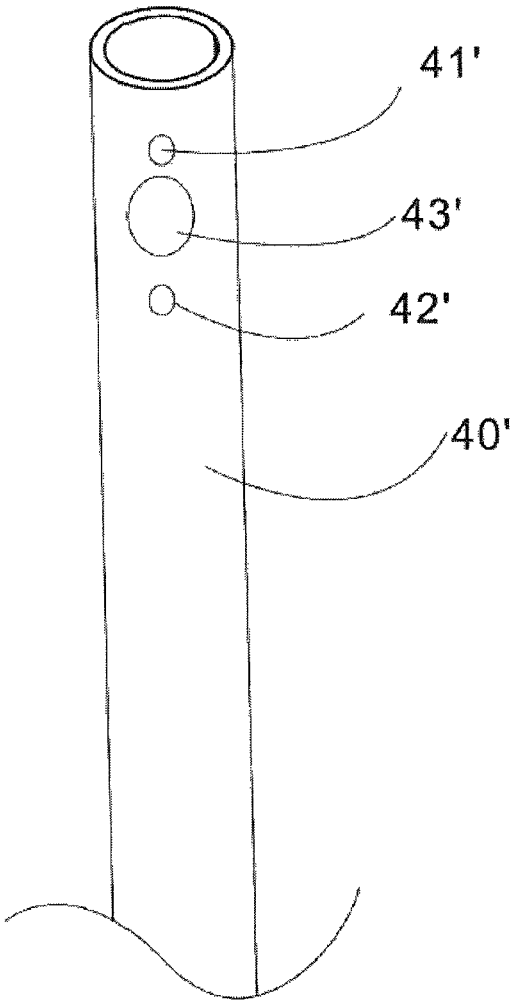
FIG. 9 is a structural schematic diagram of a lamp pole of embodiment 4.

Taking the circular lamp pole 40' as an example, the mounting hole sites of the current lamp pole 40' are generally fixed, as shown in FIG. 9, usually an upper hole site 41', a lower hole site 42' and a big middle hole site 43'. The positions of the 3 hole sites are generally fixed. That is, the position of each hole site when delivery is fixed. However, the positions of the lower hole sites from different factories are usually different. In the actual mounting process, the upper hole site and the big hole site are usually easy for alignment and mounting, but the lower hole site is difficult to align due to different positions, thereby making mounting difficult.

To solve the technical problem, on the basis of the embodiment 1, the connecting device 10 is provided with a fixing piece 44 for matching the lamp pole 40; the shape of one side of the fixing piece 44 matches the lamp pole 40; the upper part of the fixing piece 44 is provided with a first hole site 41; the first hole site 41 is provided with a first bolt 45 for being fixedly combined with the lamp pole; the middle part of the fixing piece is provided with a bushing 43; the lower part of the fixing piece 44 is provided with a plurality of second hole sites arranged up and down or an elongated slot 42; and the second hole site or the elongated slot 42 is provided with a second bolt 46 for being fixedly combined with the lamp pole.

As a more preferred specific implementation, a technical solution of providing the lower part of the fixing piece with an elongated slot 42 is preferred. This is because, although multi-hole site (i.e., second hole sites arranged up and down) can correspond to mounting holes in different positions of the lamp pole, it is still a limited selection and a misalignment possibly occurs, such as, for example, the mounting hole of the lamp pole is located between two second hole sites on the lower part of the fixing piece. However, for the elongated slot, the misalignment can be solved. No matter how much the up-down offset is, it can be adjusted as long as it is within the elongated slot. Therefore, the alignment adjusting ability of the elongated slot is better than multi-hole site, and thus the elongated slot can better adjust and fix the lower hole sites in different positions of the lamp pole.

Figure 12:
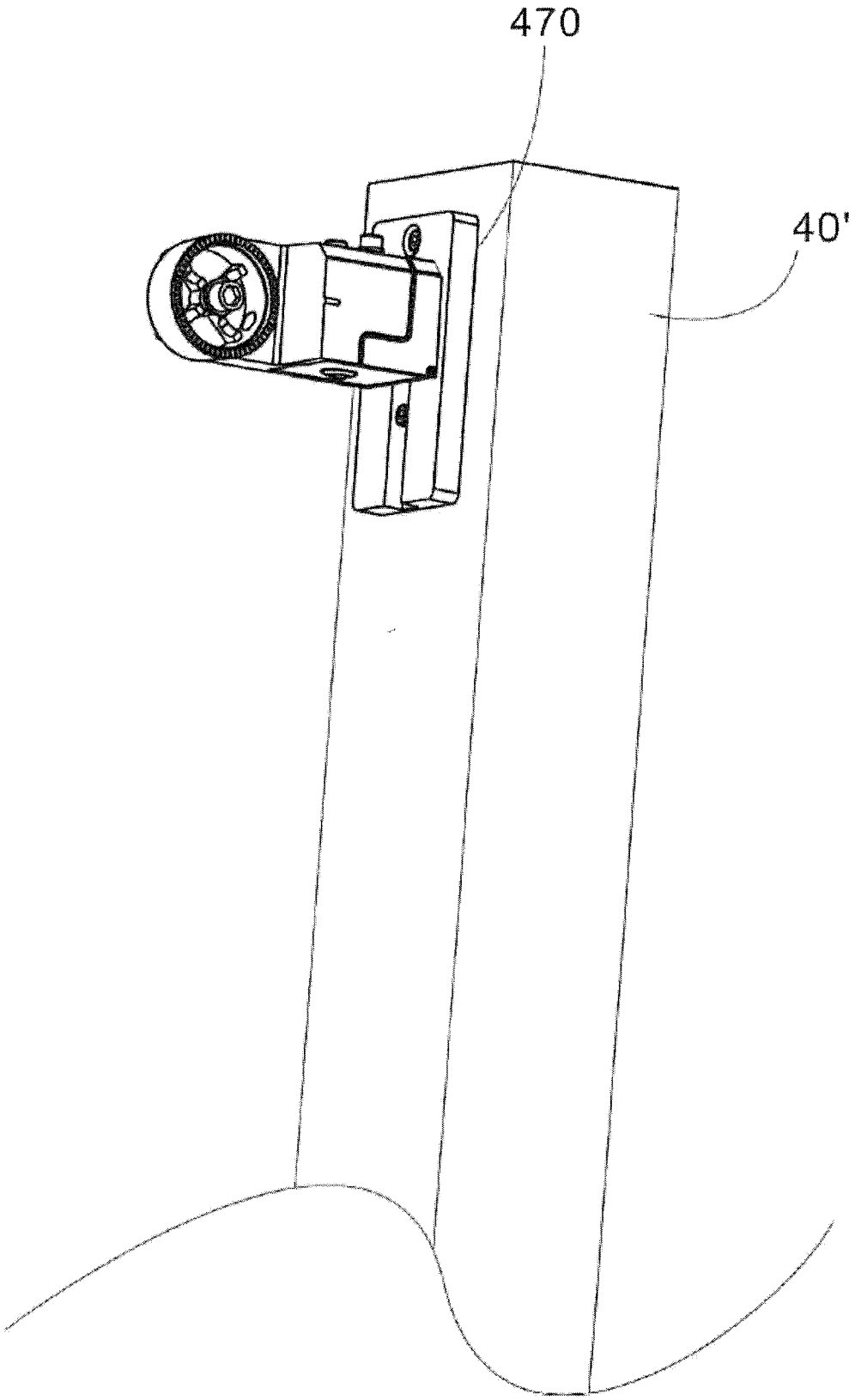
FIG. 12 is a structural schematic diagram of the hole site adjusting device (when mounted on a square lamp pole) of the connecting device of street lamp pole of embodiment 4.

As a specific implementation, the shape of one side of the fixing piece 44 is a plane 470; as shown in FIG. 12, when the lamp pole is square, the flat plate can be in tight contact with the square lamp pole.

Figure 13:
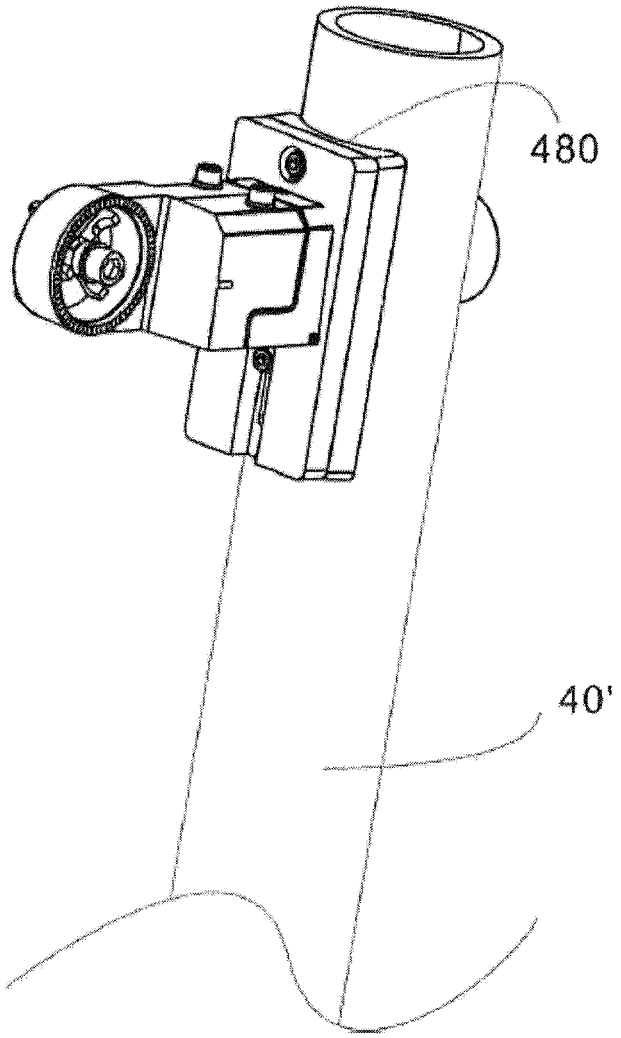
FIG. 13 is a structural schematic diagram of the hole site adjusting device (when mounted on a circular lamp pole) of the connecting device of street lamp pole of embodiment 4.
Figure 14:
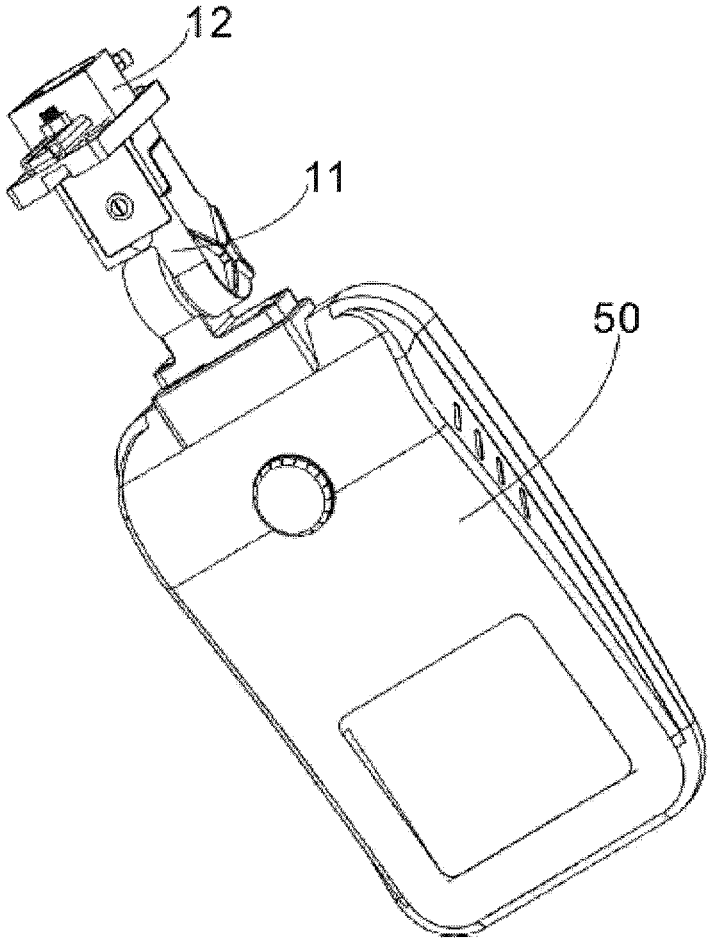
FIG. 14 is a structural schematic diagram of the connecting device (connected with the lamp holder) of street lamp pole of embodiment 4.

As another specific implementation, one side of the fixing piece 44 is an arc surface 480. As shown in FIG. 13, when the lamp pole is circular, the arc plate can be in tight contact with the circular lamp pole.

Figure 10:
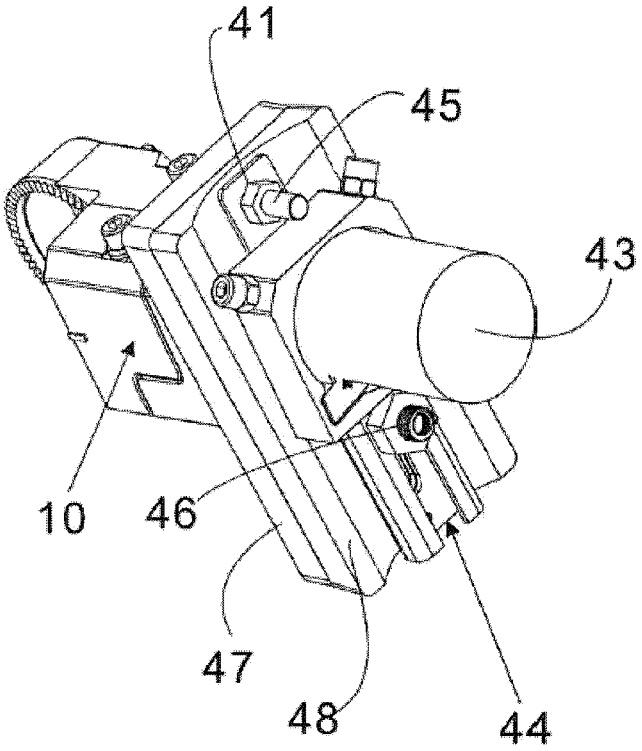
FIG. 10 is a solid structural schematic diagram of a hole site adjusting device of the connecting device of street lamp pole of embodiment 4.
Figure 11:
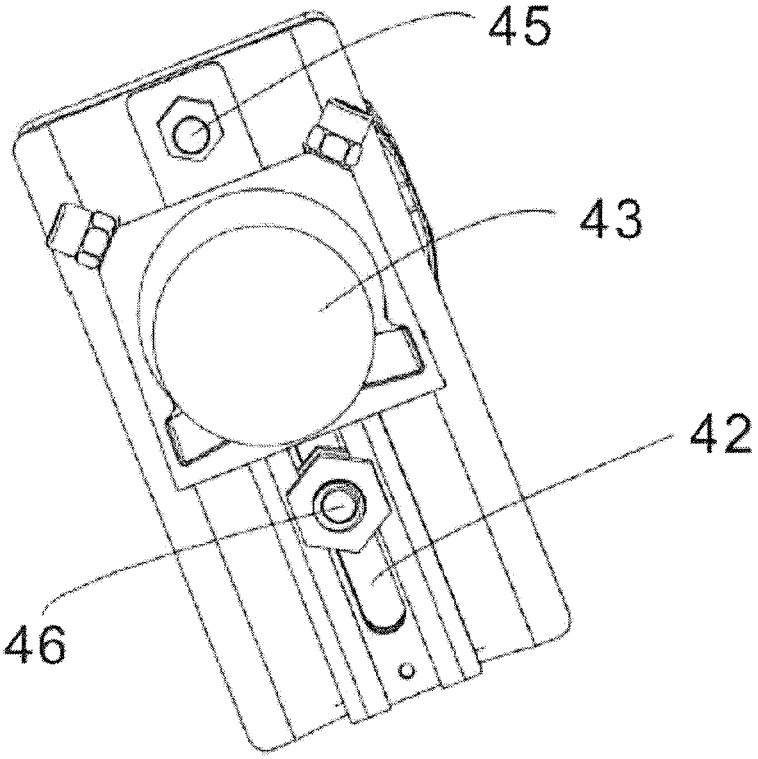
FIG. 11 is a solid structural schematic diagram of the hole site adjusting device of the connecting device of street lamp pole of embodiment 4 from another angle.

As the third specific implementation, as shown in FIG. 10, the fixing piece 44 comprises a flat plate 47 and an arc plate 48. The flat plate 47 and the arc plate 48 are detachably connected. Therefore, only the flat plate is used while requiring to be mounted on the square lamp pole; and the flat plate and the arc plate can be used while requiring to be mounted on the circular lamp pole, the arc plate is in tight contact with the circular lamp pole after fixing both plates; or only the arc plate is used.

While mounting, the fixing piece is in contact with the lamp pole; the bushing is inserted into the big hole site of the lamp pole; the first bolt is combined with the first hole site and the upper hole site of the lamp pole; the second bolt is combined with the second hole site and the lower hole site of the lamp pole; and the first and second bolts are locked respectively to complete mounting of the connecting device and the lamp pole.

The mounting of the lamp holder is shown in FIG. 4. The first connecting piece 11 and the lamp holder 50 are mounted in an aligned mode.

The series of detailed description listed above are only for the specific description of practicable embodiments of the invention, but not to limit the scope of protection of the invention. The equivalent embodiments or variation made without departing from the spirit of skill of the invention shall be contained in the scope of protection of the invention.

The invention claimed is:

1. A connecting device of a street lamp pole, wherein the connecting device comprises:

a first connecting piece and a second connecting piece;

the first connecting piece and the second connecting piece are arranged in an independent split mode;

one end of the first connecting piece is used for connecting a street lamp holder, and the other end is provided with a mortise;

one end of the second connecting piece is used for connecting the lamp pole, and the other end is provided with a tenon capable of being inserted into the mortise; and the mortise is provided with a first combining hole, the tenon is provided with a second combining hole, and when the tenon is inserted into the mortise, the first connecting piece and the second connecting piece are fixed by inserting a bolt into the first combining hole and the second combining hole;

wherein the connecting device is provided with a wiring port on a bottom;

a channel is formed by passing through the connecting device left and right;

the wiring port is communicated with the channel; and electric wires of the street lamp enter from one end of the channel and stretch out from the wiring port, and wherein the channel is provided with a wire clamp slot in a position near the wiring port.

2. The connecting device according to claim 1, wherein the top of the first connecting piece is provided with a gradienter.

3. The connecting device according to claim 1, wherein the wiring channel is provided with a cover for opening or closing the wiring port.

4. The connecting device according to claim 3, wherein the cover is connected to the bottom of the connecting device with a hinge or in a push-pull mode.

5. A connecting device of a street lamp pole, wherein the connecting device comprises:

a first connecting piece and a second connecting piece;

the first connecting piece and the second connecting piece are arranged in an independent split mode;

one end of the first connecting piece is used for connecting a street lamp holder, and the other end is provided with a mortise;

one end of the second connecting piece is used for connecting the lamp pole, and the other end is provided with a tenon capable of being inserted into the mortise; and the mortise is provided with a first combining hole, the tenon is provided with a second combining hole, and when the tenon is inserted into the mortise, the first connecting piece and the second connecting piece are fixed by inserting a bolt into the first combining hole and the second combining hole, wherein a circular channel and a square channel are formed by passing through the connecting device left and right; the circular channel and the square channel intersect and form a "Ω"-shaped channel together; the channel is equipped with a plurality of pipe diameter adjusting pieces; the pipe diameter adjusting pieces comprise a square block capable of being inserted into the square channel and an arc block capable of being inserted into the circular channel; the arc block and the square block are fixed in an up and down direction; and the arc block of each pipe diameter adjusting piece has a different radius.

6. The connecting device according to claim 5, wherein the channel is able to splice a pipe with a diameter of 60 mm; and at least two pipe diameter adjusting pieces with arc blocks of different radius are provided, so that a pipe with a diameter of 50 mm and a pipe with a diameter of 40 mm are able to be inserted, respectively.

7. A connecting device of a street lamp pole, wherein the connecting device comprises:

a first connecting piece and a second connecting piece;

the first connecting piece and the second connecting piece are arranged in an independent split mode;

one end of the first connecting piece is used for connecting a street lamp holder, and the other end is provided with a mortise;

one end of the second connecting piece is used for connecting the lamp pole, and the other end is provided with a tenon capable of being inserted into the mortise; and the mortise is provided with a first combining hole, the tenon is provided with a second combining hole, and when the tenon is inserted into the mortise, the first connecting piece and the second connecting piece are fixed by inserting a bolt into the first combining hole and the second combining hole, wherein the connecting device is provided with a fixing piece for matching the lamp pole;

the shape of one side of the fixing piece matches the lamp pole; the upper part of the fixing piece is provided with a first hole site; the first hole site is provided with a first bolt for being fixedly combined with the lamp pole; the middle part of the fixing piece is provided with a bushing; the lower part of the fixing piece is provided with a plurality of second hole sites arranged up and down or an elongated slot; and the second hole site or the elongated slot is provided with a second bolt for being fixedly combined with the lamp pole.

8. The connecting device according to claim 7, wherein the shape of one side of the fixing piece is planar or arc.

* * * * *